US005666999A

United States Patent [19]

Dewispelaere et al.

[11] Patent Number: 5,666,999

[45] Date of Patent: Sep. 16, 1997

[54] SHEDDING SELECTION DEVICES WITH BIOMORF OR PIEZO ELECTRIC BENDING ELEMENTS

[75] Inventors: Andre Dewispelaere, Marke; Carlos Derudder, Heule, both of Belgium

[73] Assignee: N.V. Michel Van De Wiele, Kortrijk-Marke, Belgium

[21] Appl. No.: 493,685

[22] Filed: Jun. 22, 1995

[30] Foreign Application Priority Data

Jun. 22, 1994 [BE] Belgium ..... 09400595
Sep. 22, 1994 [BE] Belgium ..... 09400855

[51] Int. Cl.[6] ..... D03C 3/20

[52] U.S. Cl. ..... 139/455; 66/218

[58] Field of Search ..... 139/455; 66/218, 66/219

[56] References Cited

U.S. PATENT DOCUMENTS 3,884,272 5/1975 Brenner et al. ..... 139/59
5,133,389 7/1992 Griffith ..... 139/455
5,392,820 2/1995 Seiler ..... 139/455
5,462,097 10/1995 Skalka ..... 139/455

FOREIGN PATENT DOCUMENTS 2185701 of 0000 France .
4309983 of 0000 Germany .
9005803 of 0000 WIPO .
9325744 of 0000 WIPO .
9301337 of 0000 WIPO .

*Primary Examiner*—Andy Falik
*Attorney, Agent, or Firm*—Ladas & Parry

[57] ABSTRACT

A shedding selection device for Jacquard-type weaving- and knitting machines can simply make use of bimorf or piezo-electric bending elements (9), under the condition that the complementary hooks (2,12) are resilient hooks which are resiliently mounted on one of the ascending- and descending parts of the shedding devices. Additionally the selection of shedding devices can be realized with only one such bending element (9) per harness cord (25).

13 Claims, 1 Drawing Sheet

SHEDDING SELECTION DEVICES WITH BIOMORF OR PIEZO ELECTRIC BENDING ELEMENTS

BACKGROUND OF THE INVENTION

The present invention refers to an apparatus for the selection of shedding devices in a Jacquard-type weaving- and/or knitting machine comprising of complementary ascending- and descending hooks interconnected by one and the same cord, by means of a bending element, of which the free extremity, is forced to move through the influence of a tension between a locking position on which the clamping of a complimentary hook is prevented by an ascending knife and a release position on which the clamping of a complimentary hook is possible because the detention pin slides away from the trajectory of the suspension hook of the concerned complementary hook, and whereby each suspension hook is elastic mounted on an ascending- and descending part of the shedding devices by means of flexible drawback springs.

FIELD OF THE INVENTION

It makes applications in weaving- and knitting machines suitable for the weaving and knitting of patterns.

The use of piezo-electric bending elements for the selection of the complementary hooks that are interconnected by a filiform element and a pulley, and by so doing that they can only move in the opposite direction, is already known.

DESCRIPTION OF THE PRIOR OUT

Document BE-08900181 describes a driven clamping system for the selection of complementary hooks belonging to a shedding apparatus of a weaving- and knitting machine intended for the weaving of patterns. By means of an electromagnet, an elastic positioned armature will or will not be attracted, so that the armature is brought as an elastic hook or a pivoting hook into a locking position. This electromagnetic action goes over an air gap and thereby requires a not to be neglected certain electric energy. This energy supply is partially converted into heat causing the selection equipment to heat up and thus influence the climat in the weavery.

Document DE-PS-4309983 describes a shedding apparatus that makes use of bimorf piezo-electric bending elements as selection elements of the shedding devices. These bending elements adapt to different bending forms under the influence of an electric tension, similar to the operation of a bimetal. The piezo-electric elements use very little energy. It can be compared with the charging energy of a small condenser. The piezo-electric elements develop no heat. Hence these elements form an important alternative for the electromagnetic selection of the hooks of a shedding apparatus in a weaving machine.

The disadvantage of piezo-electric bending elements however is that, at deformation, they are not naturally capable of supplying a mechanical energy of useful magnitude in case of displacement of the extremity over a distance of a few millimeters. Hence these elements are not useful when any mechanical resistance in the element to be moved must be overcome.

In this existing shedding apparatus, the piezo-electric shedding elements are sideway-retractable blocking elements that, through supply of an electric tension, are forced to move sideways and transverse to the motion direction of an extension of a pivoting click in release position. Once in a locking position, a drawback spring pushes the extension of the pivoting click against the piezo-electric elements.

When selection is required, and locking must occur, one of the knifes with corresponding hooks is in an upper position and the pivoting click is pushed to the side, so that a locking space is created on the other side of the click.

Only the piezo-element is energized, so that there is no frictional resistance.

As the pivoting clicks are positioned on a fixed part of the shedding apparatus, they are subject to contamination by dust. If the pivoting clicks become dusty, the bending elements must overcome a certain friction when they bend from the locking position just behind the extension of the hook to the release position just outside the motion trajectory of the extension piece.

The total lack of force to overcome a mechanical resistance, remains the main cause why, so far, these elements have found no extended application in selection elements for shedding devices in weaving machines. The objective of present invention is to remedy this.

SUMMARY OF THE INVENTION

With the present invention the task is realized by means of a shedding apparatus as recited in claim 1. This shedding apparatus is characterized by the fact that the complementary pliable hooks are resiliently mounted by a drawback spring on the ascending- and descending part of the shedding devices.

In a specific embodiment the hook is clamped by means of a laminated drawback spring on the ascending- and descending part of the shedding devices, in particular on a complementary flat hook.

In accordance with a particularity of the invention a pliable hook is provided with a cam at the inside.

In accordance with a development of the invention, the projection on which the pliable hook clamps itself is protected by a swing-away bimorf or piezo-electric selection element.

In accordance with a preferred embodiment of the invention, the shedding apparatus comprises only one bimorf bending element per harness cord, thus one for both complementary hooks.

The bending element is centrally positioned in a sleeve of the weaving- and/or knitting machine's frame, midway between the locking positions of the two suspension hooks.

In a specific embodiment, the free extremity of the bending element supports a bridge shaped T-piece that is provided, left and right, with two detention pins, whereby the middle leg of the T-piece exactly fits the abovementioned sleeve and provides a guiding element if deflection of the bending element, between a locking position and a release position of the two suspension hooks, occurs.

The detention pins, provided on the left and right, side of the T-piece, are intended to interlock with the resiliently mounted suspension hooks in their tracks.

Preferably, each suspension hook has a recess on its upper side, parallel with abovementioned sleeve of the frame. The recess is higher than the detention pin itself, so that a pull-out of the bending element is not obstructed, when a suspension hook gets caught on a projection.

The bending element is positioned in such a way that its natural, non-energized position, matches the release position and the suspension hook, when the complementary hook is lifted, can pull-out sideways freely.

BRIEF DESCRIPTION OF THE DRAWINGS

These characteristics and other particularities of the invention will become evident from the following description and with reference to the enclosed drawings, which for reasons of example, and not in a restrictive sense, show how the invention is made.

In these drawings the following are.

In these drawings the same reference signs indicate identical or equivalent elements.

DETAILED DESCRIPTION OF AN EMBODIMENT OF THE INVENTION

Figure 1:
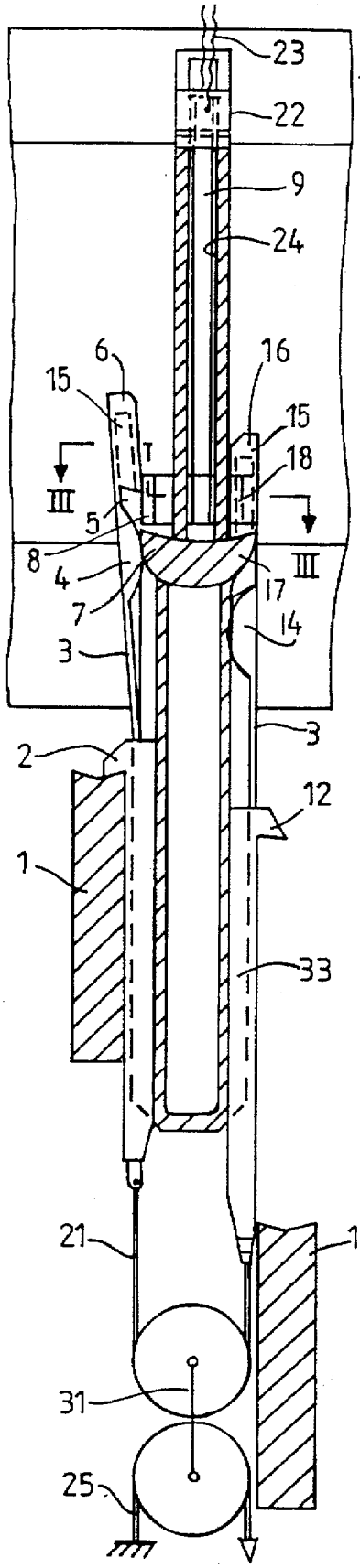
FIG. 1 is a front view comprising a partial cross-section of a base frame of a shedding device having only one piezo-electric bending element in accordance with the invention.

As shown in FIG. 1, an apparatus for the selection of shedding devices in a Jacquard-type weaving- and/or knitting machine, suitable for the weaving or knitting patterns, comprises of two complementary hooks 2,12 that are interconnected by one and the same cord 21. Complementary hooks 2,12 move up and down with complementary knifes 1,11 along a vertical frame 10, divided into a larger rectangular base frame 20 and a smaller upper part 22, in which a vertical sleeve 24 is provided. The upper part 22 and the base frame 20 are separated by two projections 7 and 17.

On the top of sleeve 24 of the upper part 22 a bimorf bending element 9 is clamped at one end. Electric wires 23 are provided for the power supply to bending element 9, whose free extremity can pull-out between a locking position and a release position (shown by a dotted line in FIG. 2) of a suspension hook 6,16 attached by means of a resilient drawback spring 3 on each complementary hook 2,12.

As shown in FIG. 1 the leaf-shaped drawback spring 3 is provided with a cam 4. When the bimorf or piezo-electric elements 9 are energized, they are bent by the tension, transverse to the plane movement of suspension hooks 6,16, T-piece 13 and the two detention pins 8,18, leave their locking positions positioned in the motion track of suspension hooks 6,16, and take a release position, located outside the motion tracks of the suspension hooks 6,16.

Detention pins 8,18 serve as selection elements to interlock with resilient suspension hooks 6,16 in their tracks. Even if one suspension hook 6,16, is caught at the projection, the T-piece of the bimorf or piezo-electric bending element can freely bend without resistance from the locking position to the release position. The elastic suspension hook 6,16 has a recess 15 at its upper side, parallel with abovementioned frame sleeve 24, and higher than the detention pin 8,18 itself in order to prevent a pull out of the bending element, when a suspension hook 6,16 gets caught on a projection 7.

The bending element is positioned in such a way that its natural non-energized position matches the release position and so that suspension hook 6,16, when the complementary hook 2,12 is lifted, can freely pull-out side-ways.

The bending element 9 can pull-out freely between the locking- and release positions and reverse, without needing to overcome a mechanical resistance.

The two complementary knives 1 and 11 of the shed formation apparatus move up and down in opposite phase.

The complementary hook 2 moves upwards along with 1. Mobile hook 6, which is mounted on to complementary hook 2, is pushed sidewards by projection 7 against the drawback force of spring element 3 and subsequently cam 4 is pushed backwards by projection 7. The action of spring element 3 of hook 2 pushes cam 4 against projection 7 and the hook portion 5 of hook 2 also experiences a drawback force from spring 3. In this position detention pin 8 can freely move a direction within the plane of FIG. 2. Under influence of an electric tension the element 9 bends in a direction that is perpendicular to the plane of FIG. 1 and the T-piece, equiped with detention pins 8, slides out of the track of suspension hooks 6,16. If the knives move, 1 now downwards and 11 upwards, cam 4 will leave projection 7 and, through the drawback force of spring 3, suspension hook or clamp 6 will hook onto projection 7. In this way suspension hook 6 will be held in an upper position while knife 1 is moved downwards. Complementary hook 12 is brought upwards with knife 11, hoist or double pulley is lifted, as will cord 25 which is interconnected to one or more harness cords that drive the double pulley 31 for the lifting of the chainwires.

With each interruption of the electric power supply element 9 returns to its original straight position so that the T-piece and detention pin 8 return to a locking position just above projection 7 in the track of hook 2,6. In this locking position, suspension hook 6 pushes, when knife 1 is descending, with its nose plane against detention pin 8. Suspension hook 6 slides over detention pin 8, subsequently over projection 7 and the complementary hook 2 therefore descends with knife 1. Hoist 31 remains on the same level and harness cord 25 therefore remains in the lower position.

The simultaneous control of the shedding devices on two different locations by means of only one bending element, is made possible thanks to the fact that the complementary hooks execute simultaneous motions in opposite directions. The knifes never ascend together. The positions of detention pins 8 and 18 can then be changed during a short time without having a direct effect on one of the two shedding devices interconnected to the same bending element.

Figure 2:
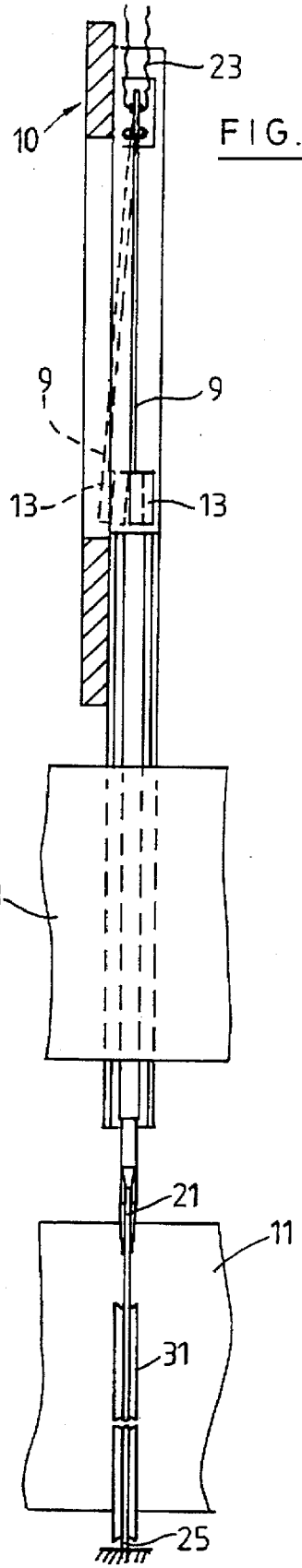
FIG. 2 is a side view of the device shown in FIG. 1.
Figure 3:
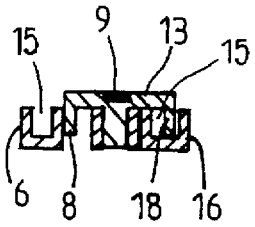
FIG. 3 is a cross-section of larger scale following line III—III of the T-piece which is mounted on the free extremity of the bending element.

The energized situation of the bending element, which is shown in FIG. 2 in full line and matches the locking position, is only maintained as long as necessary to block the track of the head of the hook.

It is obvious that the selection elements are subject to continuously alternating bending tensions at a very high rhythm imposed by the production speed.

In accordance with the invention, the selection installation has the advantage that it : allows a compact machine construction, hardly radiates any heat and is very reliable, even if the weaving- or knitting machine, is polluted after a while by dust and oil. The drawback springs may, without any disadvantage or risks of magnetic remanention, be constructed from spring steel. Such steel offers an excellent resistance against fatigue under continuous bending stress at very high rhythm.

We claim:

1. Shedding selection device in a Jacquard-type weaving and/or knitting machine comprising:

up- and downwardly complementary moving hooks (2,12.) interconnected by one and the same cord, a bending element (9) which is adapted to be clamped on one end to a frame of the weaving and/or knitting machine, said bending element being provided with electrical terminals for connection to an electric power supply, said bending element having a free extremity which moves sideways between a locking position in which clamping of a complementary hook (2,12) by an upwardly moving knife (1,11) is prevented and a release position in which the clamping of a complementary hook (2,12) is possible because detention pin means (8,18) slides away from a track of a suspension hook (6,16) of the respective complementary hook (2,12), wherein each suspension hook (6,16) is resiliently mounted by means of a resilient drawback spring (3,13) on said complementary up- and downwardly moving hooks.

2. Device according to claim 1, wherein each resilient drawback spring (3,13) is provided with a cam (4,14) on a hookside of the suspension hook.

3. Device according to claim 1, wherein the drawback spring (3,13) is laminated.

4. Device according to claim 1, wherein the bending element (9) bends in a direction perpendicular to the plane of movement of the suspension hooks (6,16).

5. Device according to claim 1, which comprises a projection (7,17) on which the suspension hook (6,16) clamps itself.

6. Device according to claim 1, wherein there is only one bending element (9) for both of a pair of the suspension hooks (6,16) of the complementary hooks (2,12).

7. Device according to claim 1, which is adapted to be positioned in a sleeve of a vertical frame of the weaving and/or knitting machine, wherein the bending element is adapted to be centrally positioned in said sleeve (24) midway between locking positions of the two suspension hooks (6,16).

8. Device according to claim 1, wherein the free extremity of the bending element (9) holds a T-piece that is provided on the left and right side with two detention pins comprising said detention pin means (8,18), whereby a middle leg of the T-piece (13) is adapted exactly to fit in a sleeve (24) of the vertical frame, said detention pins extending so as to form a guiding element when the bending element (9) moves sideways between a locking position and a release position for the two suspension hooks (6,19).

9. Device according to claim 8, wherein a pair of the detention pins (8,18) mounted to the left and right of the T-piece are engageable with the resilient suspension hooks (6,16) in their respective tracks

10. Device according to claim 8, wherein each suspension hook (6,16) has a recess (15) at an upper side parallel with a sleeve (24) of the frame (10) and higher than the detention pin (8,18) itself in order to permit a sideway movement of the bending element (9) when a suspension hook (6,16) has a release position on a projection (7).

11. Device according to claim 10, wherein the bending element is a bimorf bridge element adapted to be positioned in the sleeve of the frame in such a way that a natural, not energized position of said bimorf bridge element matches the release position of the bimorf element so that the suspension hook (6,16) can freely move sideways when the complementary hook is lifted.

12. Device according to claim 1, wherein the bending element is a bimorf bridge element.

13. Device according to claim 1, wherein the bending element is a piezo-electric selection element.

* * * * *